United States Patent [19]

Gallone

[11] 4,037,908

[45] July 26, 1977

[54] STRIP OF LIGHT-SIGNAL UNIT SHELLS

[76] Inventor: Cesare Gallone, 27, Milano Street, Cornaredo, Italy

[21] Appl. No.: 635,387

[22] Filed: Nov. 25, 1975

Related U.S. Application Data

[62] Division of Ser. No. 310,097, Nov. 28, 1972, abandoned, which is a division of Ser. No. 206,610, Dec. 10, 1971, abandoned.

[30] Foreign Application Priority Data

Dec. 12, 1970 Italy ..... 32927/70

[51] Int. Cl.[2] ..... H01J 7/44; H01J 61/64; H01K 1/62; H01R 3/02

[52] U.S. Cl. ..... 339/147 R; 428/577; 29/630 G; 315/71; 338/219; 340/381

[58] Field of Search ..... 174/68 R, 70 R, 70 C, 174/71 R, 72 R; 29/627, 630 R, 630 G, 193.5; 338/203, 219; 339/147 R; 315/71; 340/381; 113/119; 428/131, 132, 134, 137, 542

[56] References Cited

U.S. PATENT DOCUMENTS 3,484,533 12/1969 Kauffman ..... 29/627 UX

FOREIGN PATENT DOCUMENTS 2,160,139 6/1972 Germany ..... 313/318

*Primary Examiner*—Laramie E. Askin
*Attorney, Agent, or Firm*—Mason, Fenwick & Lawrence

[57] ABSTRACT

A strip of light-signal unit shells to be formed into single light-signal units including a flat sheet of conductive material having openings which form continuous longitudinal conductors along two opposite edges of the sheet, continuous transverse conductors extending from one longitudinal conductor to the other and a pair of discontinuous conductors extending from opposite continuous longitudinal conductors adjacent each of the continuous transverse conductors, and insulating shells each provided with a recess, each shell encapsulating a portion of one continuous transverse conductor and an adjacent pair of discontinuous conductors, the pair of discontinuous conductors extending into the recess.

4 Claims, 10 Drawing Figures

STRIP OF LIGHT-SIGNAL UNIT SHELLS

This application is a division of application Ser. No. 310,097, filed Nov. 28, 1972, now abandoned, which in turn is a division of application Ser. No. 206,610, filed Dec. 10, 1971, also abandoned.

BACKGROUND OF THE INVENTION

The present invention relates to a strip of light-signal unit shells which may be incorporated into a light-signal device, including a gas discharge bulb and an insulating body which is provided with conductor elements having two polarities and with terminals for connecting the elements to a circuit and to the bulb.

Presently known light-signal devices include a large number of substantially different types. It is, therefore, impossible to economically and readily supply existing market demands. In fact, light-signal devices, because of their specialized form or structure, require costly production equipment to adapt them to the varying market demands. In addition, these specialized devices increase manufacturing time which increases production costs.

It is the primary object of the present invention to provide a new and improved strip of light-signal unit shells.

Another object of the present invention is to provide a strip of light-signal unit shells which reduces the number of components required for a light-signal device.

An additional object of the present invention is to permit automatic and multiple machining which reduces production costs.

A further object of the present invention is to provide small-sized shells which can be incorporated into light-signal devices.

A still further object of the present invention is to provide a light-signal unit shell in which a stabilizing resistance element may be removably inserted to provide the required resistance according to the operating voltages indicated by market demands while permitting the recovery of resistance elements from faulty units.

These and other objects of the present invention will become apparent from the following detailed description, taken in conjunction with the accompanying drawings.

DESCRIPTION OF THE PREFERRED EMBODIMENTS

Figure 1:
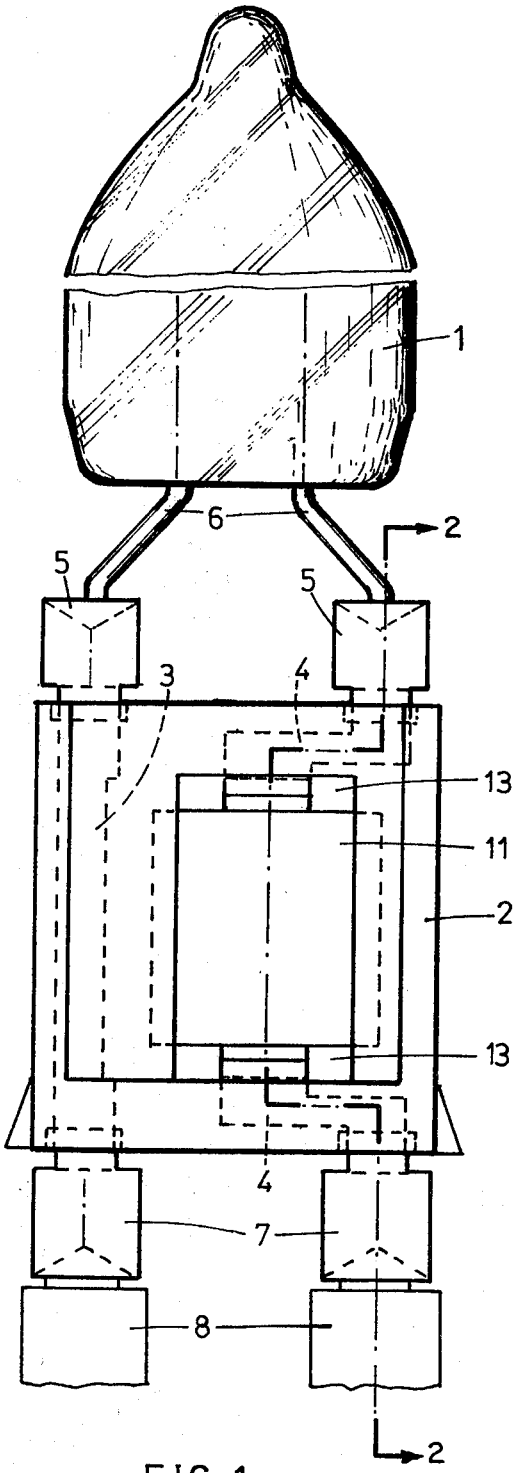
FIG. 1 is a front elevational view showing a light-signal unit produced from a strip of shells according to the present invention.
Figure 2:
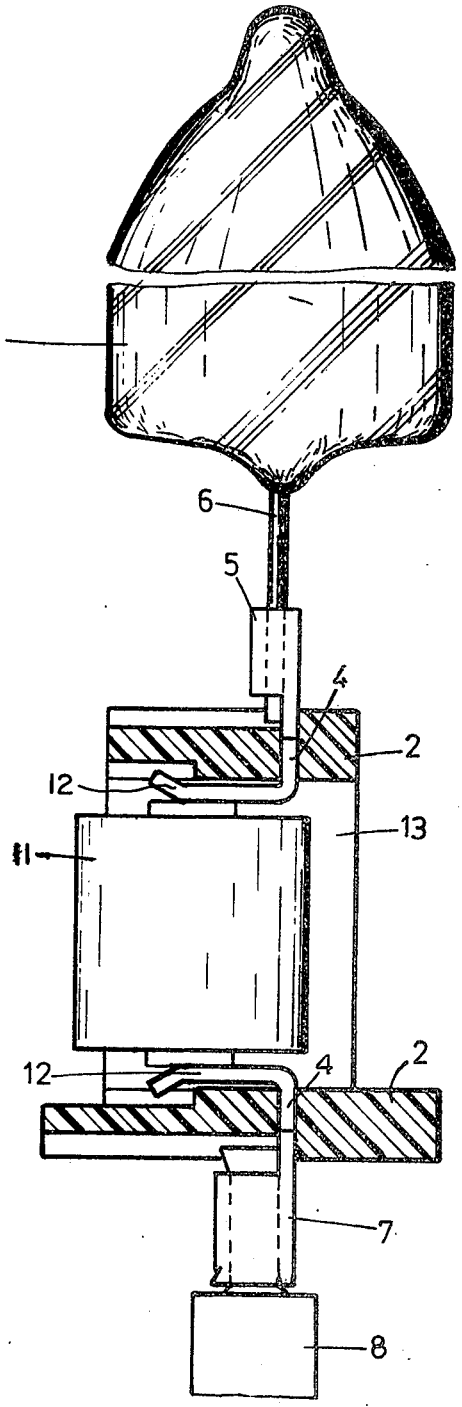
FIG. 2 is a cross-sectional view taken substantially along the line 2—2 of FIG. 1.

Referring now to the accompanying drawings, it is seen that the light-signal unit produced from the strip of shells according to the present invention includes a gas discharge bulb 1 and an insulating body 2 which may be manufactured of a plastic material. The body is provided with conductor elements 3 and 4 having two polarities. The insulating shell 2 is provided with a recess or cavity 13 within which the conductor 4 is interrupted. The recess 13 contains a resistance element 11 which is removably inserted between the ends 12 of the interrupted conductor 4 which project into the recess and are bent at 90° with respect to the plane of said conductor 4.

The conductor elements 3 and 4 are provided at their upper ends with terminals 5 which are crimped to corresponding conductors 6 of the bulb 1, and are provided at their opposite ends with terminals 7 which are crimped to the wire 8 of an electric circuit which is not shown.

Figure 3:
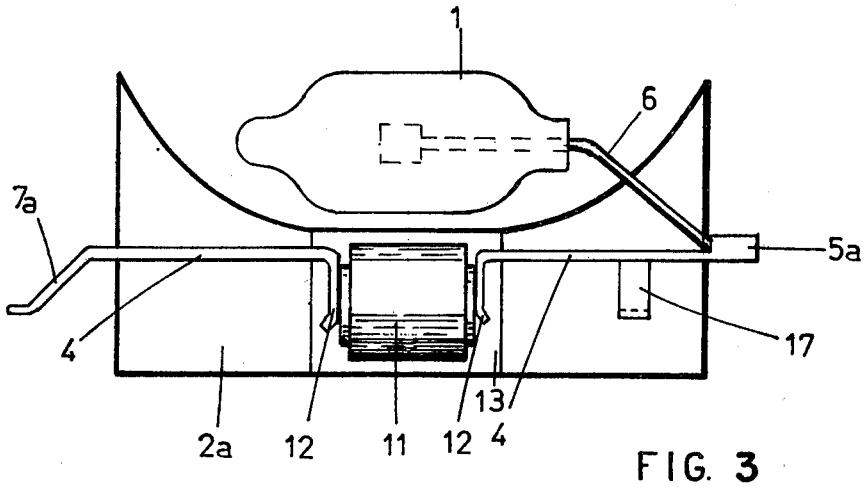
FIG. 3 is a side elevational view of an alternate light-signal unit produced from a strip of shells according to the present invention.
Figure 4:
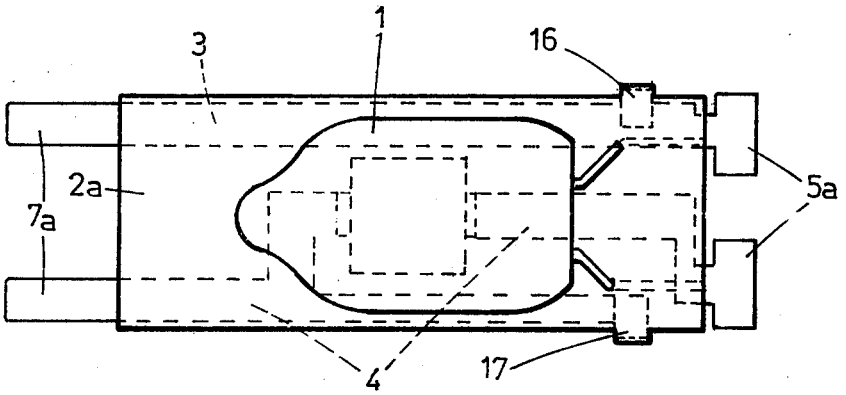
FIG. 4 is a top elevational view of the unit shown in FIG. 3.

Another embodiment of light units produced from a strip according to the present invention, as shown in FIGS. 3 and 4, includes conductor elements 3 and 4 which are provided, in addition to the terminals 5*a* and 7*a,* with extensions 16 and 17 respectively which project from the insulating shell 2*a.*

The terminals 5*a* are crimped to the conductors of the gas-discharge bulb 1. The terminals 7*a* and the extensions 16 and 17 may be fixed respectively to conductor wires of a switch, breaker or the like which are not shown.

Figure 5:
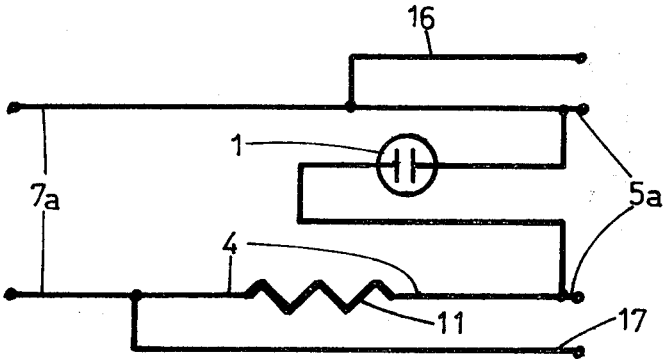
FIG. 5 is an electrical schematic of the light-signal unit shown in FIGS. 3 and 4.

For the sake of clarity, the same reference numbers have been used in FIGS. 3 and 4 and the electrical schematic diagram FIG. 5 to denote like elements.

Figure 6:
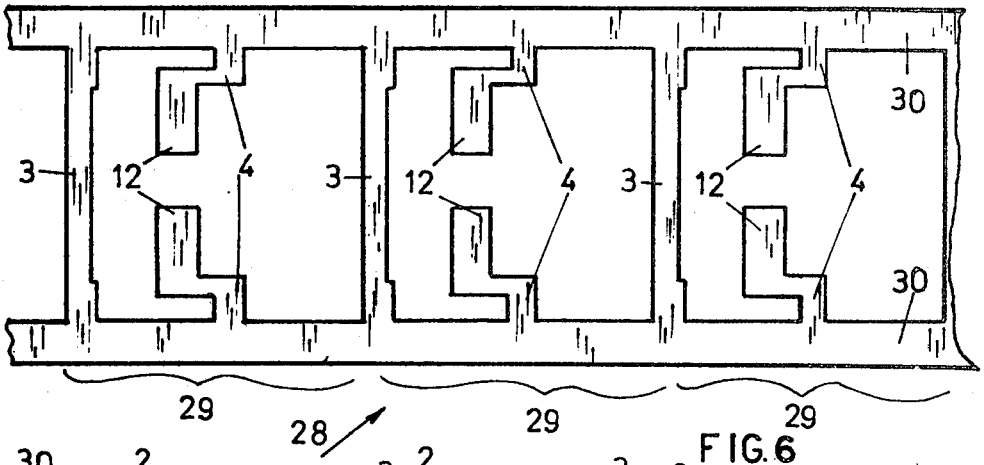
FIG. 6 is a front elevational view of the conductor strip of a preferred embodiment of the present invention.
Figure 7:
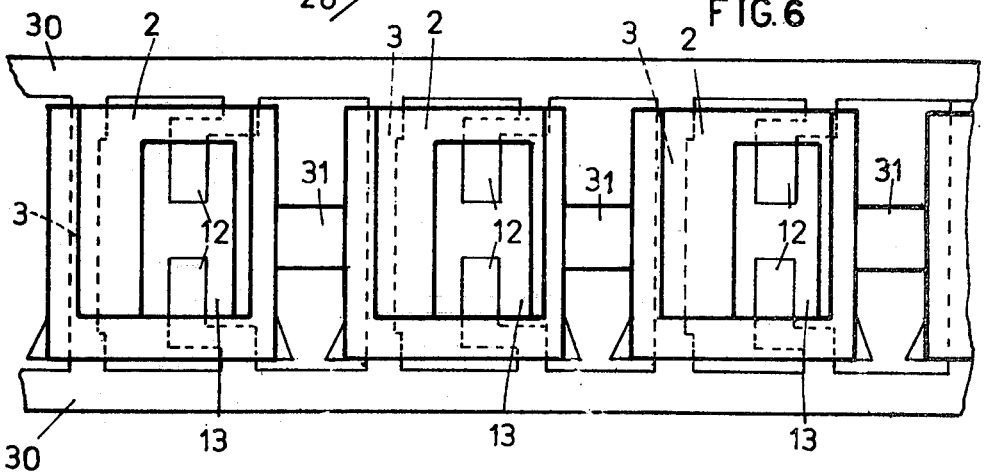
FIG. 7 is a front elevational view of a preferred embodiment of the invention incorporating the conductor strip shown in FIG. 6 with the light-signal unit insulating shells.
Figure 8:
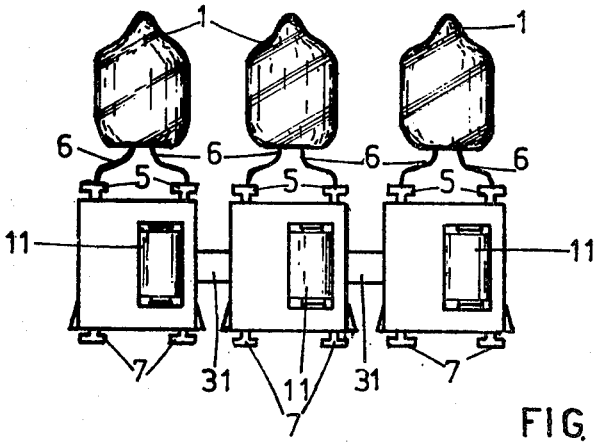
FIG. 8 is a front elevational view of light-signal units formed from the strip of shells shown in FIG. 7.

Referring now to FIGS. 6, 7 and 8, the present invention includes a conductive strip 28 which has been formed to include a plurality of shaped elements 29, each including the conductor elements 3 and 4 with the conductor element 4 discontinued at an intermediate location thereof as best shown in FIG. 6. The conductor elements 3 and 4 and shaped elements 29 are interconnected by two longitudinal metal carrier strips 30.

An insulating shell 2, having recesses 13, is molded onto each of the shaped elements 29 to produce the strip of shells as shown in FIG. 7.

Thus, the conductor elements 3 and 4 are embedded in shell 2 with only the longitudinal metal strips 30 and lengths 12 of the conductor element 4 projecting therefrom.

It should be noted that the adjacent insulating bodies 2 may be interconnected by a longitudinal strip 31 molded integral with the body. The longitudinal metal strips 30 are separated from one another to form the terminals 5 and 7 of the conductor elements 3 and 4 for each shaped element 29. The terminals 5 for the conductor elements 3 and 4 are connected to the corresponding conductors 6 of the bulb 1 as shown in FIG. 8. A resistance 11 of a predetermined value is inserted between the two bent-over lengths 12 of the conductor 4 to complete the light-signal unit.

Figure 9:
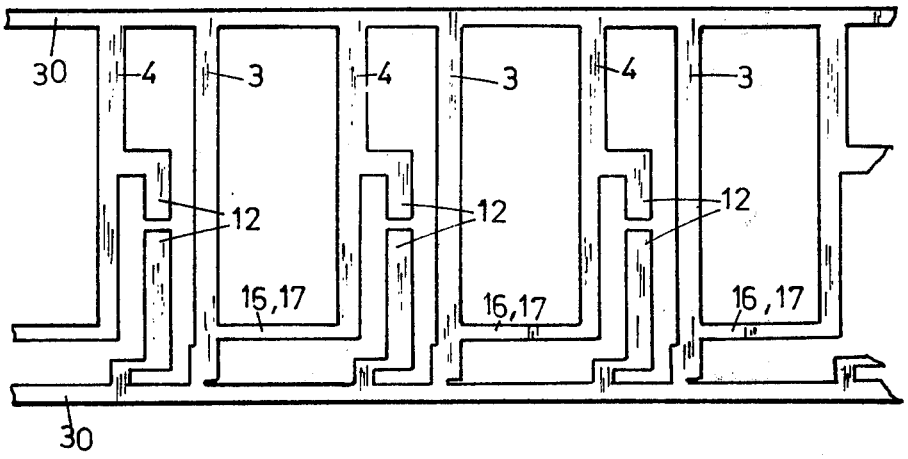
FIG. 9 is a front elevational view of an alternate embodiment of the conductor strip of the present invention.
Figure 10:
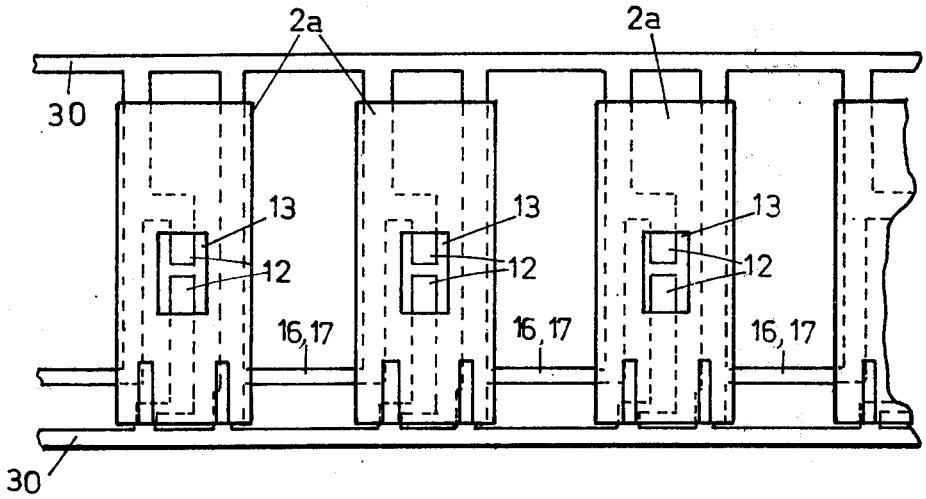
FIG. 10 is a front elevational view of an alternate embodiment of the invention incorporating the conductor strip shown in FIG. 9.

FIGS. 9 and 10 show the alternate strip and the plurality of shaped elements with the insulating bodies 2*a*. This embodiment is used to provide the unit as shown in FIGS. 3 and 4. Connecting strips 16 and 17 between conductors 3 and 4 form the extensions 16 and 17 shown in FIG. 4.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the appended claims.

I claim:

1. A strip of light-signal unit shells which can be formed into single light-signal units by installing a gas discharge bulb and a removable resistance element and separating the light-signal unit shells from the strip thereby providing single light-signal units which may be inserted into a signalling device, said strip comprising a flat sheet of conductive material having openings which form continuous longitudinal conductors along two opposite edges of said sheet, continuous transverse conductors extending from one longitudinal conductor to the other and a pair of discontinuous conductors extending from opposite continuous longitudinal conductors adjacent each of the continuous transverse conductors and terminating in free ends, insulating shells provided with a recess, each insulating shell encapsulating a portion of one continuous transverse conductor and portions of an adjacent pair of discontinuous conductors, the free ends of each pair of discontinuous conductors extending into the recess of the shell associated therewith whereby the continuous longitudinal conductors may be severed adjacent each continuous traverse conductor and each discontinuous conductor to form terminals for installation of a gas discharge bulb and whereby the ends of the discontinuous conductors extending into the respective recesses may be bent at various angles in the respective recesses to receive and provide electrical contact with a removable resistance element.

2. The strip of light-signal unit shells of claim 1 additionally including an auxiliary longitudinal conductor extending between each continuous transverse conductor and an adjacent discontinuous conductor and with the auxiliary longitudinal conductor extending between adjacent shells whereby the auxiliary conductor can be severed to form additional terminals for connections to an electrical circuit.

3. The strip of light-signal unit shells of claim 1 wherein the insulating shell is formed of plastic.

4. The strip of light-signal unit shells of claim 1 wherein the shells are interconnected by a longitudinal strip formed of the same insulating material as the shells.

* * * * *